United States Patent [19]

Roodvoets

[11] Patent Number: 4,677,800

[45] Date of Patent: Jul. 7, 1987

[54] LIGHTWEIGHT ROOFING SYSTEM

[75] Inventor: David L. Roodvoets, Westerville, Ohio

[73] Assignee: The Dow Chemical Company, Midland, Mich.

[21] Appl. No.: 639,751

[22] Filed: Aug. 10, 1984

[51] Int. Cl.[4] ..... B32B 7/10; E04B 1/80; E04B 7/00

[52] U.S. Cl. ..... 52/309.12; 52/199; 52/410

[58] Field of Search ..... 52/309.12, 410, 408, 52/199

[56] References Cited

U.S. PATENT DOCUMENTS

| | | | |
|---|---|---|---|
| 3,411,256 | 11/1968 | Best | 52/408 |
| 3,763,614 | 10/1973 | Hyde et al. | 52/408 X |
| 4,349,398 | 9/1982 | Kearns et al. | 52/309.12 X |
| 4,397,126 | 8/1983 | Nelson | 52/199 |
| 4,490,952 | 1/1985 | Winston | 52/199 |
| 4,492,064 | 1/1985 | Bynoe | 52/408 |
| 4,512,126 | 4/1985 | Walston | 52/309.12 X |
| 4,557,081 | 12/1985 | Kelly | 52/408 X |

FOREIGN PATENT DOCUMENTS

| | | | |
|---|---|---|---|
| 7622959 | 2/1978 | France | 52/309.12 |

*Primary Examiner*—Stuart S. Levy
*Assistant Examiner*—Lynn M. Sohacki
*Attorney, Agent, or Firm*—Trexler, Bushnell & Wolters, Ltd.

[57] ABSTRACT

An insulated roofing system is provided in which a waterproof membrane is applied to the roof deck. Extruded panels of closed cell polystyrene foam are provided on top of the membrane, thus protecting the membrane from thermal cycling, ultraviolet rays, and physical damage. The foam panels provide excellent insulation and are substantially impervious to water. The foam panels are extruded and are provided on the upper surface with integral ribs spaced by grooves. Lightweight reinforced concrete panels are laid directly on top of the polystryene foam and are secured thereto, preferably by adhesive spaced along the ribs. The concrete panels are provided with holes aligned with the grooves between the ribs to provide for ventilation and moisture removal on hot, dry days.

5 Claims, 2 Drawing Figures

LIGHTWEIGHT ROOFING SYSTEM

BACKGROUND OF THE INVENTION

For many years it was the universal practice to construct roofs with a waterproof layer or membrane on the outer surface thereof. Such roofing is still used in many installations, but has may disadvantages. The waterproof membrane, which may be built up sheet material and asphaltic or bitumin or which may be a single sheet of waterproof material, is exposed to extreme temperature variations, as much as 210 degrees F., to ultraviolet radiation, and to physical abrasion, all of which have a deleterous effect on the life of the roofing.

It has been common practice for a great many years to provide insulation in roof construction, and when insulation is provided below the waterproof membrane, in the roofing system outined above, it is necessary to provide a second waterproof membrane below the insulation to prevent moisture from within the building from condensing in the insulation and inhibiting or destroying its insulating qualities.

An alternative upside-down roofing construction is known in which the insulation is applied over the waterproof membrane, see for example U.S. Pat. Nos. 3,411,256 and 3,763,614. In this alternative roof construction the waterproof membrane, which may be a built up membrane or a sing1e waterproof layer such as of thermoplastic, is applied directly to the surface of the roof. Blocks of foam plastic insulation are then applied over the waterproof membrane. STYROFOAM (trademark of the Dow Chemical Company) brand of foam polystyrene plastic resin is a superior product for such use. It is a tough, closed cell rigid plastic foam having excellent moisture resistance and high compressive strength.

The STYROFOAM insulation placed over the waterproofing membrane rather than under the membrane, protects the membrane from the effects of thermal cycling, temperature extremes, and physical abuse, thus reducing maintenance costs and prolonging the life of the entire roofing system. It has been found that the membrane so protected remains at stable temperatures below 100 degrees F. even in hot summer weather. In fact, under normal conditions, the temperature of the membrane will remain within 15–20 degrees F. of the building's inside temperature.

Typically, a polymeric fabric is installed over the foam to stablize the system, and crushed stone or gravel ballast is applied to counteract the buoyancy of the insulation boards, to provide flammability resistance to the roof surface, and to shield the foam and fabric from ultraviolet radiation. As an alternative, paving blocks may be used in place of stone, particularly if traffic is to be expected on the roof.

When traffic is expected, as in the construction of a plaza deck, pedestals or stone are provided to space the paving blocks above the top of the STYROFOAM insulation to permit adequate air circulation for drying of the roofing system on warm, dry days. It will be appreciated that a base roof or deck of substantial strength must be provided to support the weight of such a roofing system.

OBJECTS AND SUMMARY OF THE PRESENT INVENTION

It is an object of the present invention to provide a lightweight roofing system in which a waterproof membrane is applied directly to the surface of a roof, suitable panels of rigid foam insulation are applied over the membrane, and concrete panels are applied directly to the foam insulation without the necessity of pedestals or stone.

More particularly, it is an object of the present invention to provide such a roofing system in which the upper surface of the foam plastic insulating blocks are ribbed, having alternating ribs and valleys, with the concrete panels supplied directly to the ribbed surface of the foam blocks.

Extruded panels of STYROFOAM insulation are now available having one surface with integrally formed, alternating ribs and grooves of equal width. I have found somewhat surprisingly, that the foam plastic material in the ribs is stiffer, stronger, and more resistant to deformation than the foam plastic material in the valleys. It is believed that this is due to molecular orientation of the material brought about as it foams during extrusion. In accordance with the present invention such foam plastic insulation material is used on top of a waterproof membrane, and concrete panels, preferably using lightweight aggregate, are applied to the ribs of such material using a suitable mastic. Holes are provided in the concrete aligned with the valleys or grooves to allow air circulation for drying of the roof system on warm, dry days.

THE DRAWINGS

The invention will best be understood from the following specification taken in connection with the accompanying drawings wherein:

FIG. 1 is a fragmentary cross-sectional view through a roofing system constructed in accordance with the principles of the present invention; and FIG. 2 is a top view thereof with a portion broken away.

DETAILED DESCRIPTION OF THE ILLUSTRATED EMBODIMENT

Figure 1:
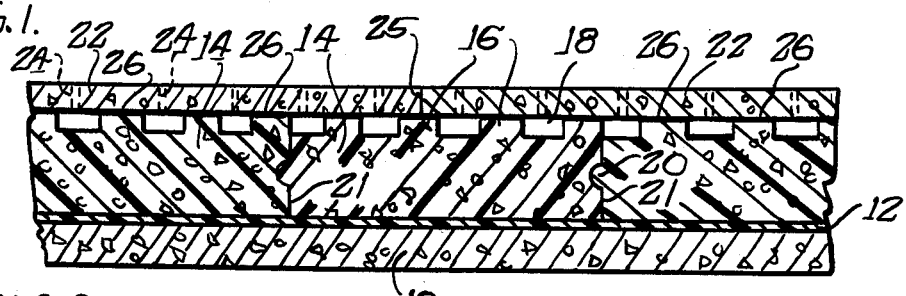
Figure 2:
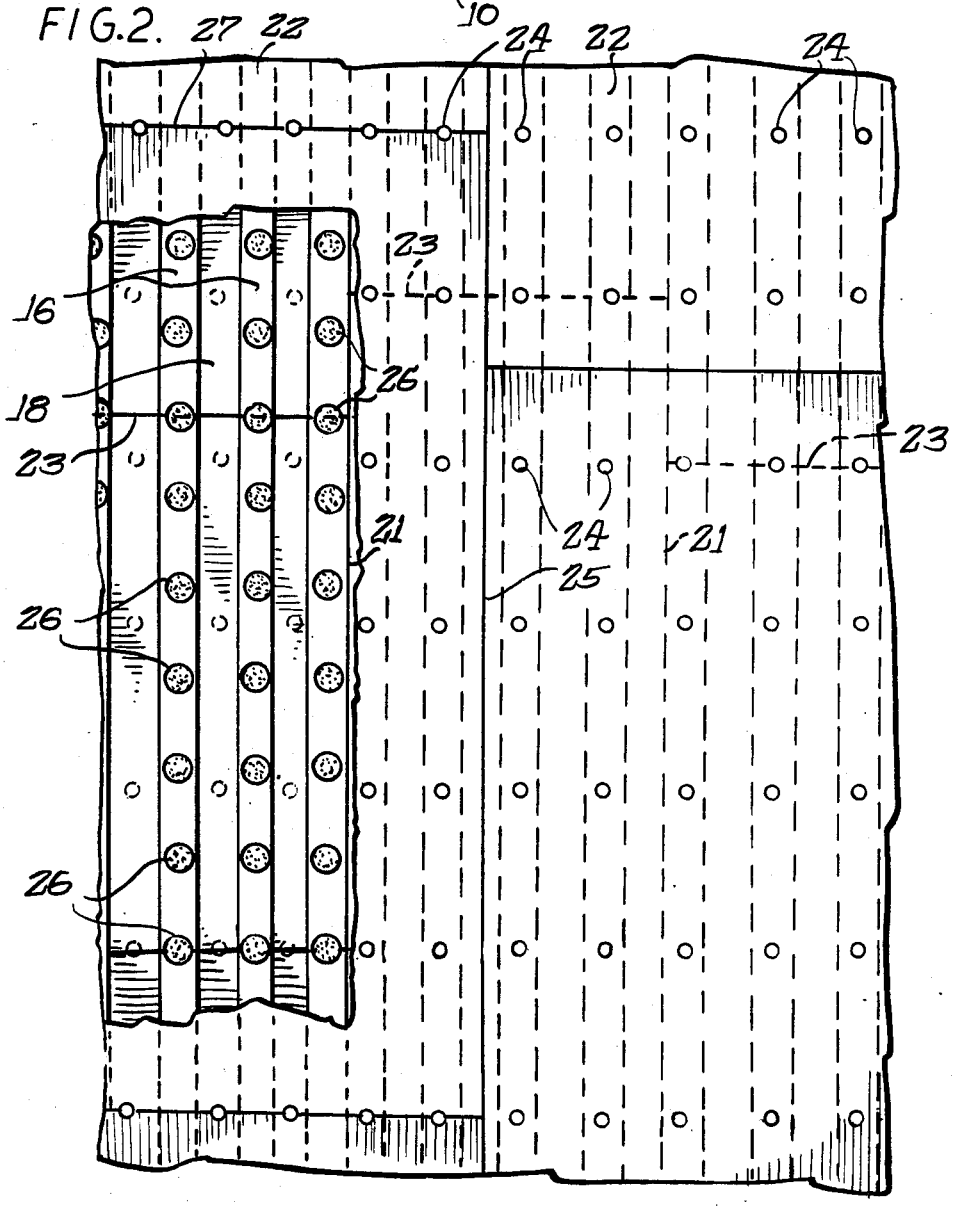

A base roof or deck 10 is shown in FIG. 1 as comprising a concrete slab. This slab would preferably be reinforced. The roof deck could equally be of wood construction, or of metal construction, and concrete simply has been chosen by way of illustration. A waterproof membrane 12 overlies the roof deck 10. The membrane can be attached to the roof deck, or it can be loose. The membrane can be a single sheet of polymeric material, or it can be a built-up membrane of sheet material with asphaltic or bitumin material added thereto.

Panels 14 of STYROFOAM extruded polystyrene foam are laid on top of the membrane 12. The foam panels include on the top surface only integrally extruded ribs 16 interspaced by grooves or valleys 18. The ribs and the grooves are of equal lateral extent, being approxitely one inch wide, and about one-quarter to one-half inch deep. I have observed that the foam material of the ribs is stronger, more rigid, and more deformation resistant than the material of the grooves or valleys, and this is thought to be due to molecular orientation produced by foaming of the plastic material during extrusion. The polystyrene foam panels preferably are interconnected by a tongue-and-groove construction 20 along the longitudinal edges 21 thereof. Alternatively, the panels could be butt edged or ship lapped. The ends 23 of the panels conveniently are simply butted together. The thickness of the foam panels depends on the degree of insulating quantity desired, but typically would be on the order of one to six inches thick. The extruded polystyrene foam is of the closed cell variety for moisture resistance. The foam panels preferably are two feet by eight feet, but other sizes are contemplated.

Reinforced concrete panels 22 surmount the foam panels 14, lying on top of the ribs 16. The concrete panels can be made of standard aggregate, but preferably utilize a lightweight aggregate. The concrete preferably is reinforced, and the reinforcing can be a continuous web or screen mesh, or preferably chopped strands or fibers. Glass fibers are preferred, although plastic such as polypropylene can be used. A fiber length of one-quarter inch to one inch is preferred. Longer fibers tend not to be practical as they tend to clump or agglomerate. One to two percent by weight of fiber is preferred, although greater amounts could be used. The concrete preferably is modified containing a latex, such as styrene-butadiene latex, or ACROSYL (trademark of PPG Industries), a latex acrylic. Other latexes could be used.

Each concrete panel 22 is provided with a plurality of holes 24 extending through the panel. These holes can be manufactured at the time that the concrete panels are manufactured, or they can be drilled or punched through the concrete. They are preferably larger than one-quarter inch diameter and less than one inch diameter. The holes are transversely spaced to line up with the grooves or valleys 18 and are spaced along the length of the valleys, preferably on the order of one to three feet. The reinforced concrete panels preferably are on the order of three feet by six feet so that longitudinal 25 and lateral 27 junctions between the concrete panels and the junctions between the foam panels can generally be kept from alignment with one another for best moisture resistance. The concrete panels are secured to the foam panels by a suitable adhesive 26 applied in discrete patches spaced along the tops of the ribs 16. The adhesive or mastic must be compatible with both the foam and the concrete, and not attack the foam. A water-based latex adhesive is preferred, and one preferred adhesive is Dow Mastic 11.

The size difference in the panels and the adhesive mounting of the concrete panels to the foam panels causes the entire system to be tied together. Alternatively, mechanical fasteners could be used between the concrete and foam panels. If mechanical fasteners are to be used they should preferably be of the expandable type properly to anchor in the foam plastic. The panels serve as a rafting device, and the holes in the panels serve as a ventilation system to allow moisture to escape from the foam on hot, dry days. The air holes also serve to improve wind resistance. The design produces a smooth roof with good traffic surface. It is lightweight and is cost effective. The latex incorporated in the concerete improves the moisture resistance of the concrete, and reduces the quantity of reinforcing fiber needed. With the waterproof membrane beneath the foam plastic, no separate vapor barrier is required.

The specific example of the invention as herein shown and described is for illustrative purposes only. Various changes will no doubt occur to those skilled in the art, and will be understood as forming a part of the present invention insofar as they fall within the spirit and scope of the appended claims.

The invention is claimed as follows:

1. A roofing system comprising a roof deck, a waterproof membrane on said roof deck, a plurality of panels of foam plastic insulation on said waterproof membrane, said foam plastic insulation panels having a plurality of ribs having substantially flat tops lying in a common plane and spaced apart by grooves on the upper surface thereof, and a plurality of concrete panels overlying said raised areas, and means securing said concrete panels to said foam plastic insulation panels comprising adhesive on the flat tops of said ribs, each of said concrete panels having a plurality of holes therethrough disposed among the raised areas for ventilation of said foam plastic insulation panels, said holes being arranged in a plurality of rows within each concrete panel aligned with and overlying and communicating with said grooves, wherein said holes permit passage of water and air through each concrete panel into and out of the grooves of said insulating panels to provide ventilation by allowing moisture to escape from the panels and to provide wind resistance.

2. A roofing system as set forth in claim 1 wherein said foam plastic insulation panels are extruded and said ribs are parallel.

3. A roofing system as set forth in claim 1 wherein said ribs and said grooves are of substantially equal width.

4. A roofing system as set forth in claim 2 wherein said ribs and said grooves are of substantially equal width.

5. A roofing system as set forth in claim 1 wherein said foam plastic insulation panels are extruded, said raised areas comprise parallel ribs spaced apart by grooves, said ribs and grooves being of substantially equal width, wherein the means securing the concrete panels to the foam plastic insulation panels comprises adhesive spaced along said ribs.

* * * * *